US009651962B2

(12) United States Patent
Bernardon

(10) Patent No.: US 9,651,962 B2
(45) Date of Patent: May 16, 2017

(54) SYSTEM AND METHOD FOR A LINEAR VOLTAGE REGULATOR

(71) Applicant: Infineon Technologies Austria AG, Villach (AT)

(72) Inventor: Derek Bernardon, Villach (AT)

(73) Assignee: Infineon Technologies Austria AG, Villach (AT)

( * ) Notice: Subject to any disclaimer, the term of this patent is extended or adjusted under 35 U.S.C. 154(b) by 253 days.

(21) Appl. No.: 14/287,944

(22) Filed: May 27, 2014

(65) Prior Publication Data

US 2015/0346749 A1 Dec. 3, 2015

(51) Int. Cl.
*G05F 1/00* (2006.01)
*G05F 1/575* (2006.01)
*G05F 1/56* (2006.01)

(52) U.S. Cl.
CPC ..... *G05F 1/575* (2013.01); *G05F 1/56* (2013.01)

(58) Field of Classification Search
CPC . G05F 1/575; G05F 1/56; G05F 1/465; G05F 1/462; G05F 1/565; G05F 1/468; G05F 1/562; G05F 1/567; G05F 1/569; G05F 1/571; G05F 1/573
USPC ..... 323/283, 273–281
See application file for complete search history.

(56) References Cited

U.S. PATENT DOCUMENTS 6,188,211 B1 * 2/2001 Rincon-Mora ..... G05F 1/575 323/273
7,106,032 B2 9/2006 Chen et al.
8,716,993 B2 5/2014 Kadanka
2009/0195234 A1 * 8/2009 Arnold ..... G05F 1/56 323/299
2010/0109624 A1 5/2010 Lourens et al.
(Continued)

FOREIGN PATENT DOCUMENTS

CN 101807853 A 8/2010
CN 102216867 A 10/2011
CN 103376816 A 10/2013

OTHER PUBLICATIONS

Bernardon, D. et al, "A high-precision low-drop linear regulator for battery charging application," Proceedings of the 27th European Solid-State Circuits Conference, ESSCIRC 2001, Sep. 18-20, 2001, pp. 65,68.
(Continued)

*Primary Examiner* — Jessica Han
*Assistant Examiner* — Lorena Bruner
(74) *Attorney, Agent, or Firm* — Slater Matsil, LLP

(57) ABSTRACT

In accordance with an embodiment, a method of operating a power supply includes measuring an output signal of the power supply, determining a control voltage based on the measured output signal, and determining whether a supply voltage of a voltage follower circuit is greater than a first threshold. When the supply voltage of the voltage follower circuit is greater than the first threshold, the control voltage is applied to an input of the voltage follower circuit and an output of the voltage follower circuit is applied to a control node of an output transistor in a first mode. When the supply voltage of the voltage follower circuit is not greater than the first threshold, the voltage follower circuit is shut down and the control voltage is applied to the control node of the output transistor in a second mode.

17 Claims, 6 Drawing Sheets

(56) References Cited

U.S. PATENT DOCUMENTS

| | | | | |
|---|---|---|---|---|
| 2010/0207591 | A1 | 8/2010 | Imura | |
| 2012/0176109 | A1 | 7/2012 | Riederer | |
| 2013/0271095 | A1 | 10/2013 | Jackum et al. | |
| 2013/0285631 | A1 | 10/2013 | Bisson et al. | |
| 2013/0307501 | A1* | 11/2013 | Kadanka | G05F 1/56 323/274 |

OTHER PUBLICATIONS

Guo, J. et al., "A 6- μW Chip-Area-Efficient Output-Capacitorless LDO in 90-nm CMOS Technology," IEEE Journal of Solid-State Circuits, vol. 45, No. 9, Sep. 2010, pp. 1896-1905.

Hazucha, P. et al., "Area-Efficient Linear Regulator With Ultra-Fast Load Regulation," IEEE Journal of Solid-State Circuits, vol. 40, No. 4, Apr. 2005, pp. 933-940.

Jackum, T. et al., "A digitally controlled linear voltage regulator in a 65nm CMOS process," 17th IEEE International Conference on Electronics, Circuits, and Systems (ICECS), Dec. 12-15, 2010, pp. 982,985.

Jackum,T. et al., "Fast Transient Response Capacitor-Free Linear Voltage Regulator in 65nm CMOS," 2011 IEEE International Symposium on Circuits and Systems (ISCAS), May 15-18, 2011, pp. 905-908.

* cited by examiner

SYSTEM AND METHOD FOR A LINEAR VOLTAGE REGULATOR

TECHNICAL FIELD

The present disclosure relates generally to an electronic device, and more particularly to a system and method for a linear voltage regulator.

BACKGROUND

Many electronic devices, such as microcontrollers, central processing units (CPU), memory devices, and the like, require a defined supply voltage. A linear voltage regulator may be used to provide such a defined supply voltage from an input voltage that is higher than the desired supply voltage. A linear voltage regulator includes a pass device, such as a transistor, connected between a supply input for receiving the input voltage and an output for providing the defined supply voltage to a load. A control circuit controls the pass device such that the supply voltage corresponds to a desired voltage.

The control circuit for a linear regulator may be implemented using analog control circuitry, digital control circuitry, or a combination of both. When digital control circuit and methods are used, the linear voltage regulator may include circuitry configured to sample the output of the power supply and convert the sampled output to the digital domain. Once the sampled output is processed in the digital domain, a control signal is applied to the pass device.

Some of the common specifications of a voltage regulator include load transient response, dropout voltage, output voltage ripple, and power supply rejection ratio. The load transient response pertains to how fast the voltage regulator responds to a changed load condition. This load transient response may be limited, for example, by stability considerations within the regulation loop. In some cases, the quantized and sampled nature of the digital controller may reduce the phase margin of the power supply.

The dropout voltage pertains to how low the regulator input voltage can approach the controlled output voltage and still maintain operation, and the voltage ripple pertains to the amplitude of a voltage disturbance is seen at the output voltage, which may be periodic in some cases. Again, the sampled and quantized nature of a digital controller may cause some voltage ripped in a digitally controlled linear voltage regulator. Lastly, the power supply rejection ratio pertains to how well the linear voltage regulator rejects changes in its supply voltage.

SUMMARY OF THE INVENTION

In accordance with an embodiment, a method of operating a power supply includes measuring an output signal of the power supply, determining a control voltage based on the measured output signal, and determining whether a supply voltage of a voltage follower circuit is greater than a first threshold. When the supply voltage of the voltage follower circuit is greater than the first threshold, the control voltage is applied to an input of the voltage follower circuit and an output of the voltage follower circuit is applied to a control node of an output transistor in a first mode. When the supply voltage of the voltage follower circuit is not greater than the first threshold, the voltage follower circuit is shut down and the control voltage is applied to the control node of the output transistor in a second mode.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context: a system and method for a linear voltage regulator. While the example embodiments are addressed to a digitally controlled linear voltage regulator, the invention may be applied to other systems and applications including analog linear voltage regulators, power supply systems, control systems, and other electronic systems.

In embodiments of the present invention, a digitally controlled linear voltage regulator includes a pass device that is driven by a voltage follower transistor. This voltage follower transistor is driven by a resistor loaded continuous time current analog-to-digital converter (IDAC). During operation, power is supplied to the voltage follower transistor via an external power supply. However, under low supply conditions, the voltage follower transistor is bypassed and the pass device is directly driven by the output of the IDAC. The dynamic performance under these low supply conditions may be compensated by adjusting the digital control algorithm and by changing the resistive loading of the IDAC. Moreover, a low dropout voltage may be achieved by using a boosted power supply for the IDAC.

Stability of the digitally controlled linear voltage regulator is enhanced by designing the poles of associated with the voltage follower circuit and the output of the IDAC to be higher than the open loop bandwidth of the regulator, or to allow one of them to be compensated by the zero from the PID controller. In addition, low voltage ripple may be achieved by keeping a product of the IDAC LSB current and a load resistor to be less than an LSB of an analog to digital converter coupled to the input of the digital controller.

Figure 1:
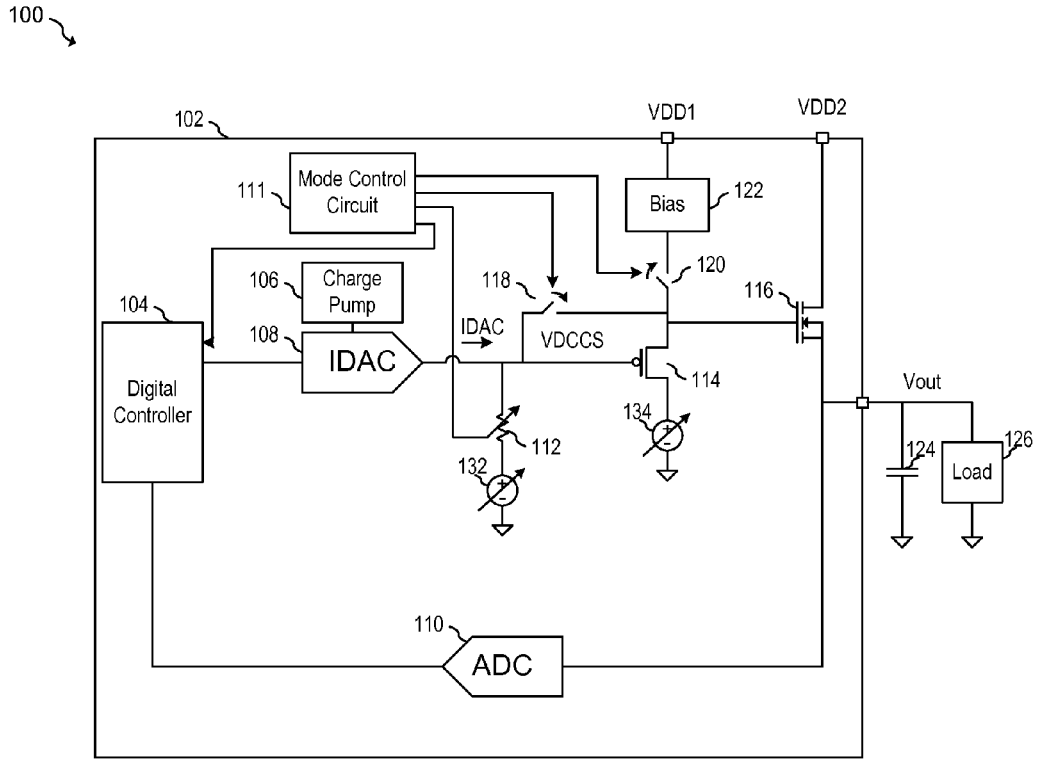
FIG. 1 illustrates an embodiment linear voltage regulator.

FIG. 1 illustrates a schematic of an embodiment digitally controlled linear voltage regulator 100 that includes integrated circuit (IC) 102 coupled to load 126 and capacitor 124. In an embodiment, IC 102 includes ADC 110 that performs an analog-to-digital conversion of power supply output voltage Vout and provides a digital value to digital controller 104. Digital controller 104 provides a digital value to IDAC 108, the output of which is coupled to resistor 112 and PMOS source follower transistor 114, which drives the gate of pass transistor 116. Mode control circuit 111 shuts off the bias current to PMOS source follower transistor 114, couples the output of IDAC 108 to the gate of pass transistor 116 and adjusts the value of resistor 112 when supply voltage VDD1 decreases to the point of approaching a dropout voltage.

In an embodiment, ADC 110 is implemented using an 8-bit successive approximation ADC. ADC 110 operates using a 20 MHz clock and performs an analog-to-digital conversion in 13 clock cycles according to one specific example. It should be understood that, in alternative embodiments, an ADC having a different number of bits, a different clock frequency, and different specifications may be used. Moreover, ADCs of different architectures may also be used according to the particular specifications of the particular embodiment.

Digital controller 104 may be implemented using a processor that executes code, using hardwired logic, or using other digital logic known in the art. In one embodiment, digital controller 104 executes a digital control algorithm that may include, for example, a proportional-integral-differential (PID) controller. In some embodiments, digital controller 104 may also determine a loop error signal.

IDAC 108 produces an output current in response to a digital value provided by digital controller 104. In an embodiment, IDAC 108 may be implemented using a plurality of binary weighted current sources and/or thermometer coded unit current sources, or a combination thereof according to circuits and methods known in the art. Alternatively, other IDAC architectures may be used. In an embodiment, charge pump 106 provides a boosted power supply to IDAC 108 in order to increase its output compliance range. For example, in one embodiment, ADC 110 and digital controller 104 may be powered using a 1.5 V power supply, while IDAC 108 may operate using a 7.5 V power supply provided by charge pump 106. As such, ADC 110 and digital controller 104 may be implemented using, for example, fine geometry low voltage transistors, while some or all of the circuitry in IDAC 108 and charge pump 106 may be implemented using higher voltage devices. Alternatively, other power supply voltages and semiconductor technology partitioning may be used.

In some embodiments, optional DC voltage sources 132 and 134 may be placed in series with resistor 112 and transistor 114, respectively. By using voltage sources 132 and 134, the output range of IDAC 108 may be reduced, thereby decreasing the size of IDAC 108. In some embodiments, voltage source 132 and 134 may be adjustable and/or controllable.

In an embodiment, power supply voltages VDD1 that powers PMOS source follower transistor 114 and VDD2 that powers pass transistor 116 may range in voltage between about 5.5 V and about 40 V, while the controlled output voltage Vout of linear voltage regulator 100 may range in voltage between about 3.3 V and about 5 V depending on the how digital controller 104 is configured. Alternatively, other power supply voltage ranges and controlled output voltage ranges may be used.

As the voltage of VDD1 approaches 5.5 V, assuming a regulated output voltage of about 5V, bias network 122 may begin to fall out of compliance. For example, if VDD1 operates at 5.5 V, and Vout is set to be 5.0 Volts, there is very little headroom left, if any, for bias network 122 to provide current to PMOS source follower transistor 114. It should be understood that in other embodiments, bias network may begin to fall out of compliance when VDD1 reaches other voltages besides 5.5 V. The voltage at which there is a loss of compliance may depend, for example, on the regulated output voltage, the specific circuit architecture, the particular device technology used and various operating conditions.

Figure 2:
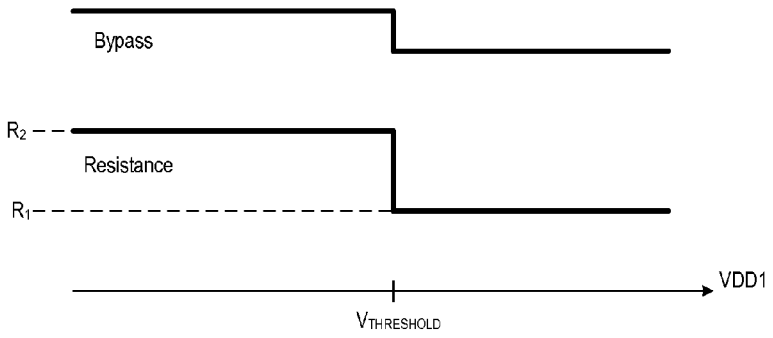
FIG. 2 illustrates a graph showing an embodiment bypass mode.

Mode control circuit 111 is configured to sense this low voltage condition, for example, by monitoring the anode with respect to the cathode of the diode 118. If the diode is forward biased then mode control switches to a low drop mode. Otherwise, mode control circuit 111 indicates a normal mode. Alternatively, mode control circuit 111 may monitor this condition by measuring the voltage at input terminals VDD1 and/or VDD2 and/or Vout directly. For example, as shown in FIG. 2, a bypass mode is active when VDD1 is less than threshold voltage $V_{THRESHOLD}$ and inactive when VDD1 is greater than threshold voltage $V_{THRESHOLD}$.

Under nominal operating conditions, switch 118 is open to isolate the output of IDAC 108 from the source of PMOS voltage follower transistor 114, and switch 120 is closed to allow bias current from bias network 122 to flow though PMOS source follower transistor 114. Once the low voltage condition is detected by mode control circuit 111, switch 118 is closed and switch 120 is opened, thereby turning off PMOS source follower transistor 114 and connecting the output of IDAC 108 to the gate of pass transistor 116. The resistance of resistor 112 may be adjusted to compensate for a change in loop gain and loop dynamics due to the bypassing of PMOS source follower transistor 114, and/or to compensate for the change in bias conditions when PMOS source follower transistor 114 is bypassed. For example, as shown in FIG. 2, the resistance of resistor 112 is a value of $R_1$ when VDD1 is greater than threshold voltage $V_{THRESHOLD}$, and the resistance of resistor 112 is a value of $R_2$ when VDD1 is less than threshold voltage $V_{THRESHOLD}$.

As shown, the resistance of $R_2$ is greater than the resistance of $R_1$. In an embodiment, by making $R_2$ larger than $R_1$, pass transistor 116 is controllable using a voltage $IDAC_{RANGE}*R_2$, which permits more current to flow in the gate of pass transistor 116. The control algorithm implemented by digital controller may be adjusted to compensate for the increased resistance. In addition, the state of mode control circuit 111 may be provided to digital controller 104 in order to adjust the digital control algorithm to compensate for these changes in loop gain and/or loop dynamics due to the change in resistance and circuit configuration.

In an embodiment, IDAC 108 has a nominal output current of about 50 μA and PMOS source follower transistor 114 has a nominal bias current of about 100 μA. Pass transistor 116 may have a nominal output current of about 150 mA depending on the particular load conditions and digital controller configuration. In an embodiment, pass transistor 116 may be implemented using an n-channel DMOS transistor, however, in alternative embodiment, other transistor types such as a bipolar transistor such as a PNP, NPN a Darlington bipolar transistor, or simply an NMOS device may be used for PMOS source follower transistor 114 and/or pass transistor 116. In some embodiments, driving pass transistor 116 with a source follower improves power supply rejection performance because the gate of pass transistor 116 sees relatively low impedance. This low impedance may attenuate power supply disturbances that may be coupled to the output terminal Vout via the gate-drain capacitance of pass transistor 116.

In an embodiment, the analog circuitry of linear voltage regulator 100 has pole whose frequency is determined by load capacitor 124 and the resistance of load 126:

$$\omega_{PL} = \frac{1}{2\pi\left(\frac{R_L \cdot 1/gm_{OT}}{R_L + 1/gm_{OT}}\right)C_L},$$

where $\omega_{PL}$ is the plant pole angular frequency, $R_L$ is the load resistance, $C_L$ is the capacitance of capacitor 124, and $gm_{OT}$ is the transconductance of the pass transistor 116. In some embodiments, the dynamic response of the power supply is based on the closed loop response of the transfer function implemented by digital controller 104 and the pole at frequency $\omega_{PL}$.

The remaining system poles due to loading at the gates of PMOS source follower transistor 114 and pass transistor 116 may be configured to have a frequency that is higher than the open loop frequency $f_{C_{OpenLoop}}$ of the system, or one and/or both of these poles can be compensated by one or more zeroes generated by the digital controller, since these poles are relatively fixed in frequency, it is henceforth simple to compensate these poles. For example, a pole due to resistor 112 and the gate capacitance of PMOS source follower transistor 114 may be expressed as:

$$\omega_{P1} = \frac{1}{2\pi R C_{G-PMOS}},$$

where $\omega_{P1}$ is the first pole angular frequency, R is the resistance of resistor 112 and $C_{G-PMOS}$ is the gate capacitance of PMOS source follower transistor 114. Likewise, a pole due to the source impedance of PMOS source follower transistor 114 and the gate capacitance of pass transistor 116 may be expressed as:

$$\omega_{P2} = \frac{1}{2\pi(1/gm_{SF})C_{G-DMOS}},$$

where $\omega_{P2}$ is the second pole angular frequency, $gm_{SF}$ is the transconductance of PMOS source follower transistor 114 and $C_{G-DMOS}$ is the gate capacitance of pass transistor 116.

In an embodiment, first and second pole frequencies $\omega_{P1}$ and $\omega_{P2}$ can be set to be at least ten times high than the open loop bandwidth of the regulator such that $\omega_{P1}$ & $\omega_{P2} \geq 10 \cdot 2\pi f_{C_{OpenLoop}}$, or one and/or both of these poles can be compensated by one or more zeroes generated by the digital controller, since these poles are relatively fixed in frequency, it is henceforth simple to compensate. For example, in one embodiment, $\omega_{P1}$ may be set to satisfy the condition that $\omega_{P1} \geq 10 \cdot 2\pi f_{C_{OpenLoop}}$ and $\omega_{P2}$ may be set such that $\omega_{P2} = 2\pi f_{Zero2POD}$, where $f_{Zero2PID}$ is a zero implemented by the digital controller. Alternatively, $\omega_{P2}$ may be set to satisfy the condition that $\omega_{P2} \geq 10 \cdot 2\pi f_{C_{OpenLoop}}$, and $\omega_{P1}$ may be set such that $\omega_{P1} = 2\pi f_{Zero2PID}$, where $f_{Zero2PID}$ is a zero implemented by the digital controller. By doing so, the effect of poles $\omega_P$, and $\omega_{P2}$ on the loop dynamics and phase margin may be made negligible, in some embodiments. As such, digital controller 104 may be configured to have a higher gain so as to increase the dynamic response of voltage regulator 100. Moreover, by placing poles $\omega_P$, and $\omega_{P2}$ at a higher frequency, pole placement within digital controller 104 may be simplified. In embodiments that utilize PID controller, a load pole and the pole due to the gate of the DMOS may be compensated for using two zeroes generated by the PID controller. In this specific embodiment, the remaining poles are placed at frequencies higher than the open loop transfer function crossover frequency $2\pi f_{C_{OpenLoop}}$.

In accordance with an embodiment, voltage ripple at of the regulated output voltage Vout may be decreased and/or eliminated by ensuring that one LSB of voltage output VDCSS of IDAC 108 is smaller than the step of one LSB of ADC 110 such that:

$$VDCCS = I_{LSB}R < V_{ADC-LSB},$$

where $I_{LSB}$ is the LSB current of IDAC 108 and $V_{ADC-LSB}$ is the LSB voltage of ADC 110. By making one LSB of voltage output VDCSS of IDAC 108 smaller than the LSB of ADC 110, the controller is able to find a "rest point" in steady state conditions. When the controller settles to an output voltage VDCCS, which is within the zero error bin of the ADC, the error going into the controller will stay at zero in some embodiments. In some examples, the zero error bin of the ADC may be programmed to any desired value. Therefore, the controller in this condition causes a steady state where no changes occur, thus no ripple will be observed. In some embodiments, the VDCCS node is constantly being biased with a constant current, thereby compensating for leakages. Thus, a steady state condition can be found where all nodes stay biased at a specific voltage without requiring a change in current to readjust the output voltage. Once the linear regulator is operating in a same zero error bin, the output ripple is either significantly attenuated and/or eliminated.

Figure 3:
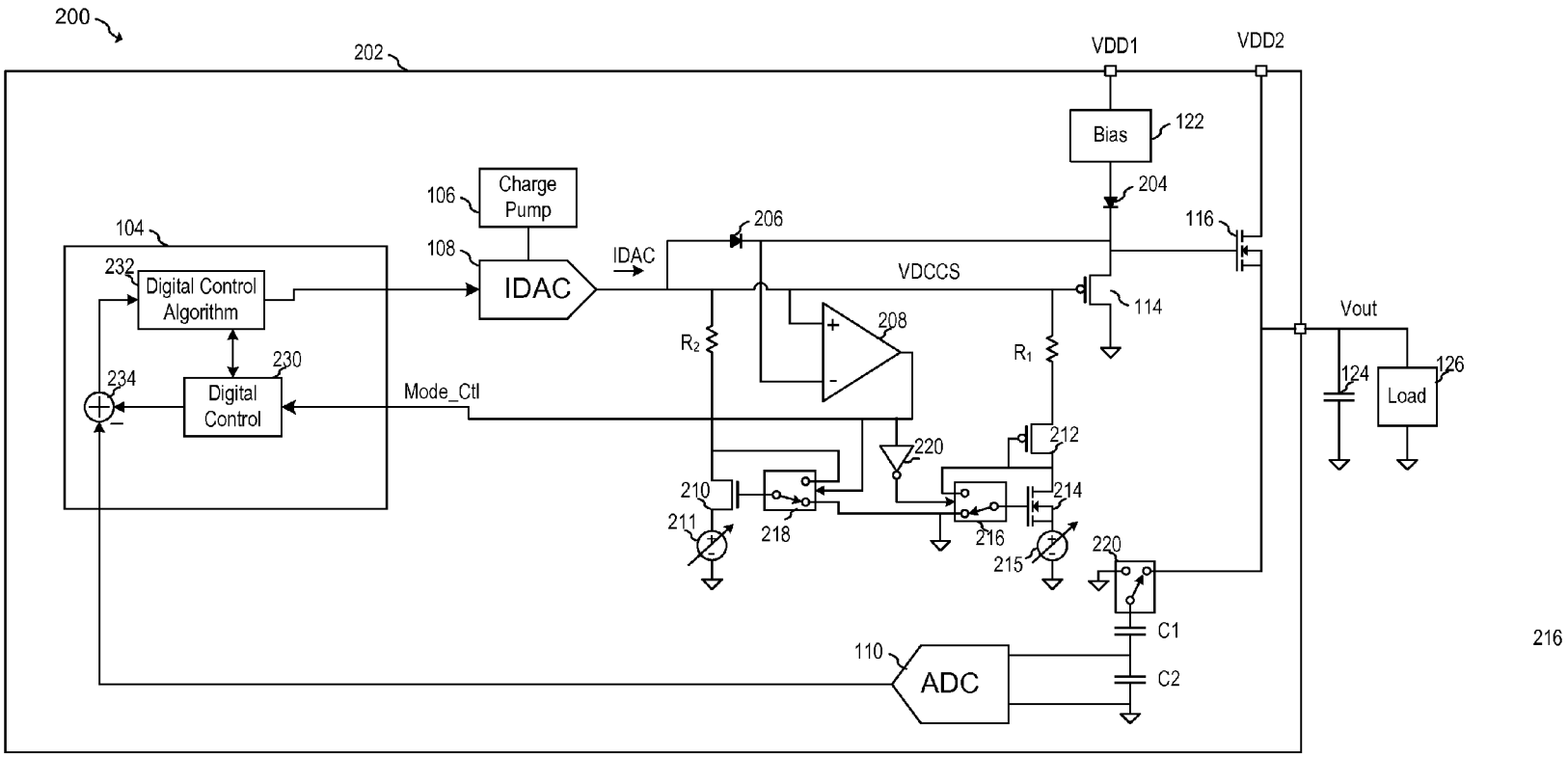
FIG. 3 illustrates a schematic of another embodiment linear voltage regulator.

FIG. 3 illustrates linear voltage regulator system 200 that shows a more detailed view of some of the circuit blocks of IC 202. In an embodiment, digital controller 104 includes digital control algorithm block 232, summation block 234 and digital control block 230. Summation block 234 subtracts a value provided by the output of ADC 110 from a digital value representing the desired set point for output voltage Vout. Digital control algorithm block 232 applies a control algorithm, such as a PID control algorithm to the output of summation block 234. Alternatively, other control algorithms besides a PID algorithm may be used. In an embodiment, digital control block 230 also provides coefficients to digital control algorithm block 232 and/or selects between preset coefficients. Digital control block 230 may also control the coefficients and algorithm used by digital control algorithm block 230 according to the state of mode selection signal Mode_Ctl that is based on whether or not PMOS source follower transistor 114 is bypassed due to a low voltage condition at VDD1.

In an embodiment, the bypassing of PMOS source follower transistor 114 is implemented using diodes 206 and 204. For example, when power supply voltage terminal VDD1 has sufficient headroom, diode 204 is forward biased to allow current flow from power supply terminal VDD1 to PMOS source follower transistor 114. In addition, the diode 206 coupled between the output of IDAC 108 and the source of PMOS source follower transistor 114 is reverse biased. When power supply terminal VDD1 experiences a low voltage condition, diode 204 becomes reverse biased and diode 206 becomes forward biased, thereby shutting off current flow to PMOS source follower transistor 114 and connecting the output of IDAC 108 to the gate of pass transistor 116. In some embodiments, the function of diodes 206 and 204 are analogous to the function of switches 118 and 120 shown in FIG. 1.

In an embodiment, comparator 208 detects a low voltage condition of power supply input VDD1 by monitoring the gate-source voltage of PMOS source follower transistor 114. When the gate-source voltage of PMOS source follower transistor 114 becomes positive, thereby indicating that the transistor is shut off, the output Mode_Ctl of comparator 208 goes high indicating the low voltage condition. In some embodiments, output Mode_Ctl of comparator 208 is used to select the shunt resistance coupled to the output of IDAC 108. For example, when Mode_Ctl is low, the output of inverter 220 is high, and switch 216 connects the gate of transistor 214 to its gate, thereby creating a DC path from node VDCCS to ground via resistor $R_1$. Accordingly, switch 218 connects the gate of transistor 210 to ground, thereby effectively disconnecting resistor $R_2$. When Mode_Ctl is high, indicating a low voltage condition, switch 216 connects the gate of transistor 214 to ground, thereby disconnecting resistor $R_1$, and switch 218 connects the gate of transistor 210 to its drain, thereby creating a DC path from node VDCCS to ground via resistor $R_2$. In some embodiments, the output of comparator 208 is also coupled to digital controller 104 to provide an input signal for adjusting the control algorithm.

In some embodiments, optional DC voltage sources 211 and 215 may be placed in series with resistors $R_2$ and $R_1$, respectively. By using voltage sources 211 and 215, the output range of IDAC 108 may be reduced, thereby decreasing the size of IDAC 108. In some embodiments, voltage source 211 and 215 may be adjustable and/or controllable.

In some embodiments, transistor 212 is the same type of transistor as PMOS source follower transistor 114 and transistor 214 is the same type of transistor as pass transistor 116. By using replica transistors, the bias voltage at node VDCCS will track changes in the gate source voltages of PMOS source follower transistor 114 and pass transistor 116. Additional tracking accuracy may be obtained by thermally coupling transistor 214 with pass transistor 116. It should be understood the circuit for selecting resistors $R_1$ and $R_2$ is just one example of many possible selection circuits. For example, in some embodiments, the resistance coupled between node VDCCS and ground may be a switchable resistor network that couples and decouples a plurality of resistors coupled in series and or parallel. In further embodiments, the state of VDD1 may be monitored directly at terminal VDD1 and/or at other nodes within IC 202.

According to various embodiments, the output voltage Vout is divided prior to being digitized by ADC 110. As shown, a switched capacitor voltage divider that includes switch 240, capacitor C1 and capacitor C2 may be used to perform this voltage division. In one example, to perform a voltage division by n, capacitor C2 is set to a capacitance of about (1/n−1)C1. During operation, switch 240 grounds one terminal of capacitor C1 while capacitor C2 is grounded by internally circuitry within ADC 110. Next, capacitor C1 is reconnected to output voltage Vout such that the input to ADC 110 is the divided voltage. It should be understood that in alternative embodiments, other voltage divider circuits and methods known in the art, such as resistive voltage dividers, may be used.

Figure 4A:
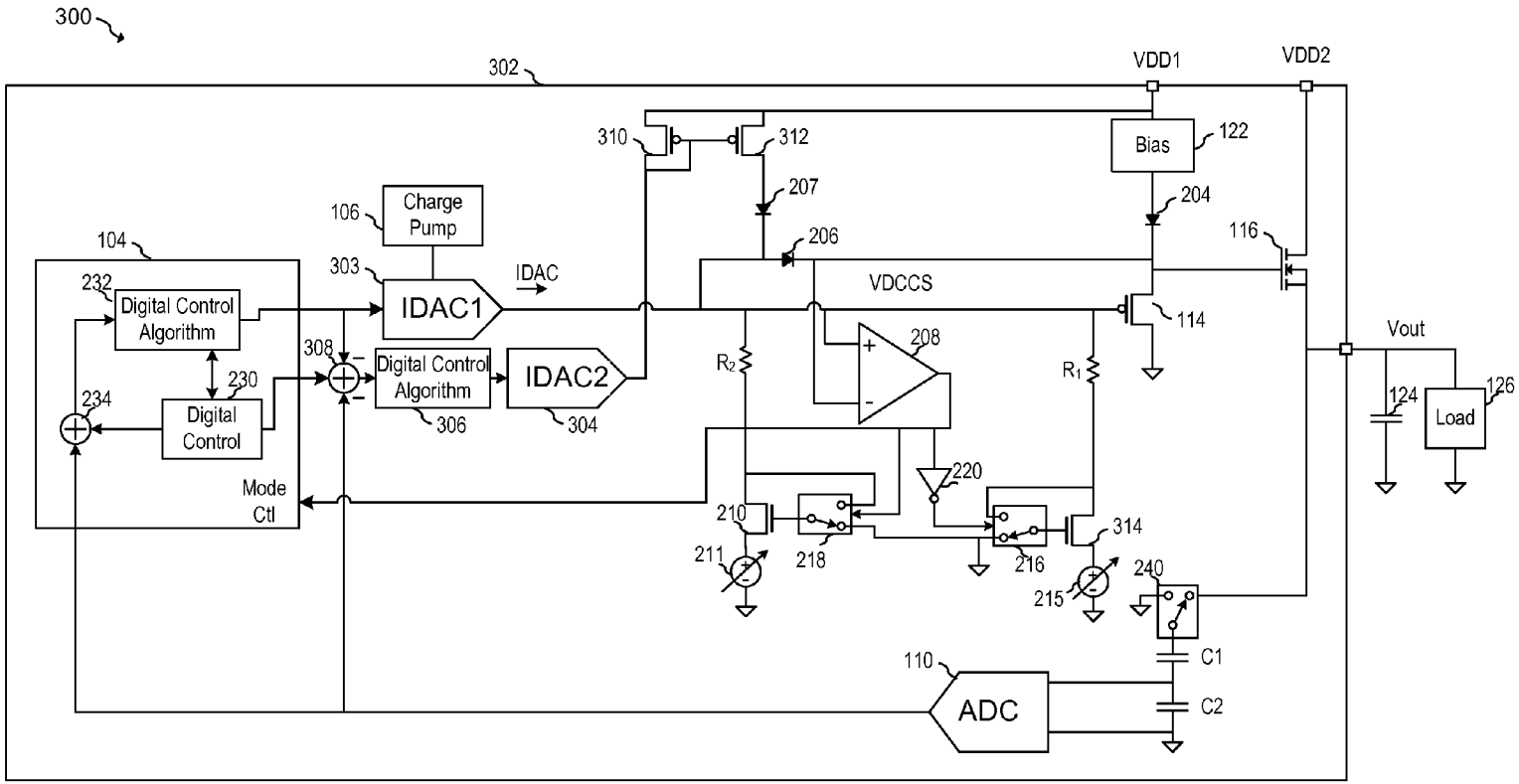
FIGS. 4*a-b* illustrate schematics of further embodiment linear voltage regulators.

FIG. 4*a* illustrates linear voltage regulator system 300 according to a further embodiment. As shown, linear voltage regulator system 300 includes IC 302 that has two IDACs: IDAC1 303 and IDAC2 304. The output of IDAC2 304 is coupled to node VDCCS via current mirror transistors 310 and 312 along with diode 207. In an embodiment, IDAC2 304 is configured to have a full-scale output range, while IDAC1 303 is configured to have an output range that is smaller than IDAC2 304. In one example, the output range of IDAC1 303 is about 2 LSBs of IDAC 2 304. Accordingly, IDAC2 304 may function as a coarse DAC, and IDAC1 303 may function as a fine-tuning DAC. By implementing IDAC1 303 to have a smaller output range, the physical size of IDAC1 303 may be made smaller than a DAC that would need to handle the entire current range, thereby saving chip area and power.

In an embodiment, both IDAC1 303 and IDAC2 304 are active when VDD1 operates with excess headroom. In low voltage conditions, however, IDAC2 304 is shut down and IDAC1 303 alone supplies current to the gate of pass transistor 116. $R_2$ is selected to be sufficiently larger $R_1$ to maintain a bias for pass transistor 116 when only IDAC1 303 having the smaller output current range is active. According to one embodiment, system 300 may be implemented as having two parallel control loops: one with IDAC1 303 and one with IDAC2 304. As such, IDAC2 304 has its own controller 306 fed by summing element 308 that also implements a digital control algorithm, such as a PID control algorithm. Alternatively, other control algorithms may be used. In some implementations, the speed of both loops is approximately the same such that the coefficients for controllers 232 and 306 for both loops are proportional.

As shown, replica devices corresponding to PMOS source follower transistor 114 and pass transistor 116 are not coupled in series with resistor $R_1$. Rather, transistor 314 is used to select resistor $R_1$. Alternatively, replica devices may be used as shown in FIG. 3.

Figure 4B:
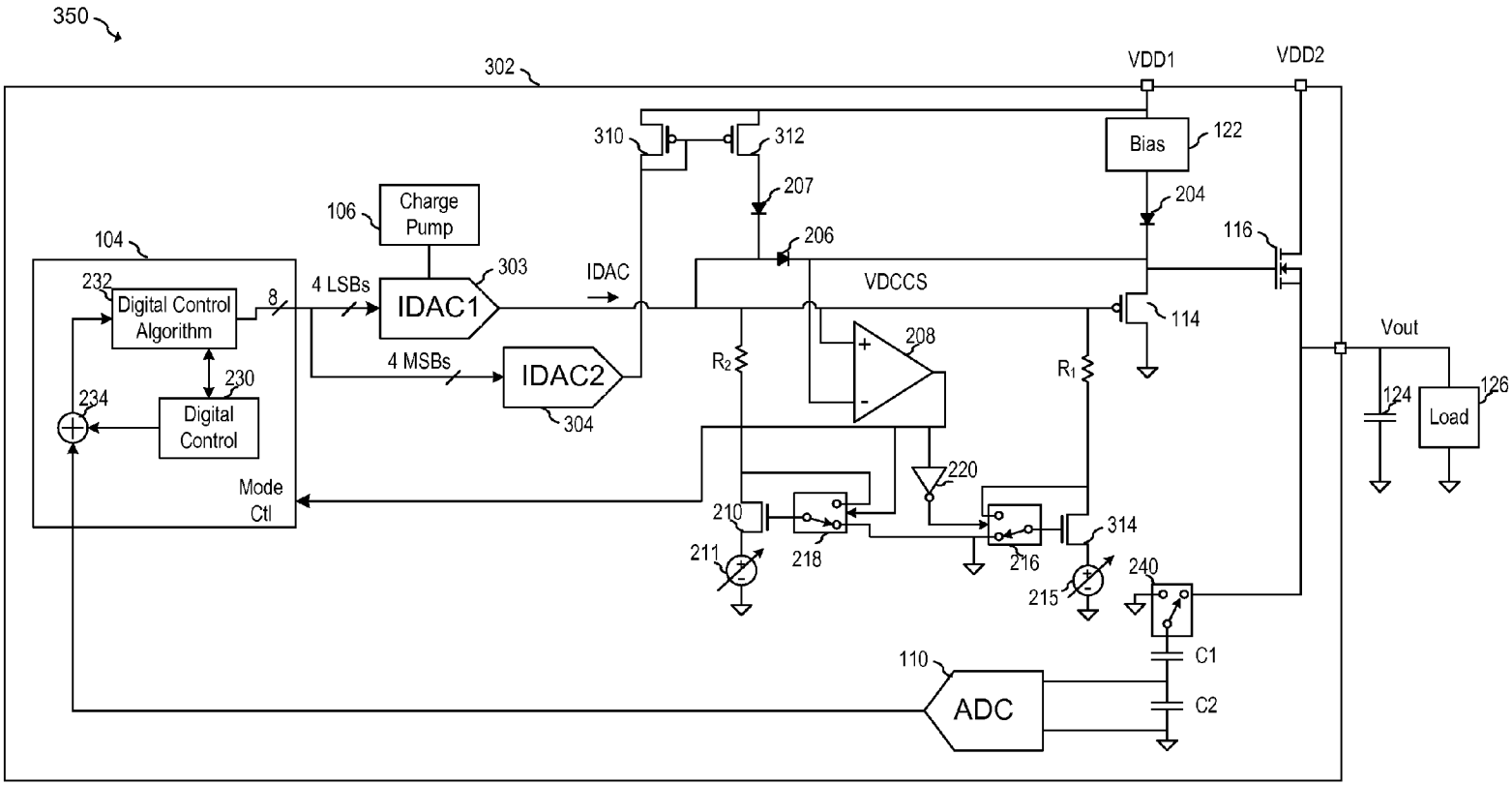

FIG. 4*b* illustrates linear voltage regulator system 350 according to a further embodiment. Linear voltage regulator system 350 shown in FIG. 4*b* is similar to linear voltage regulator system 300 shown in FIG. 4*a*, with the exception of how IDAC1 303 and IDAC2 204 are interfaced to digital controller 104. In system 350, digital controller 110 produces an 8-bit output word, of which the four most significant bits are output to IDAC2 304 and the four least significant bits are output to IDAC2 303. As such IDAC1 303 provides the fine resolution output current and IDAC2 304 produces the coarse resolution output current. It should be understood, however, that in alternative embodiments of the present invention, the bit width of the output word of digital controller may be different from the 8 bits of the example. Moreover, the partitioning of the MSBs and LSBs to IDAC1 303 and IDAC2 304 may be also be different.

Figure 5:
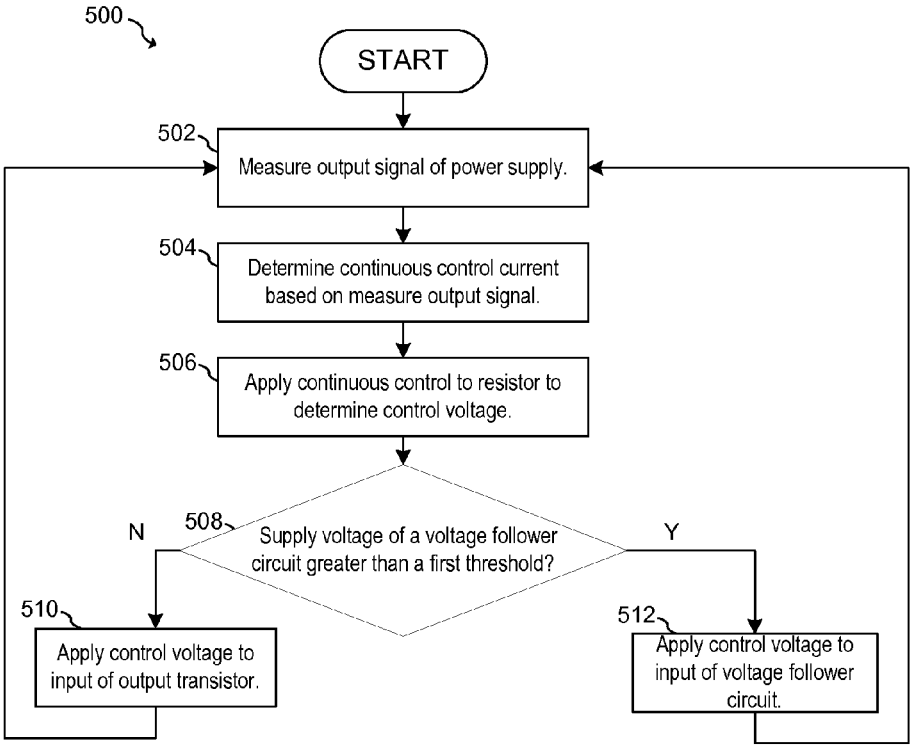
FIG. 5 illustrates a flowchart of an embodiment method.

FIG. 5 illustrates an embodiment method 500 of operating a linear voltage regulator. In step 502, the output voltage of the linear voltage regulator is measured. Next, in step 504, a continuous control current is determined based on the measured output signal. This continuous control signal may be determined using, for example, analog and/or digital signal processing techniques. In step 506, a control voltage is determined by applying the continuous control current to a resistor. A determination is then made whether or not a supply voltage of a voltage follower circuit is greater than a first threshold in step 508. If the supply voltage of a voltage follower circuit is greater than a first threshold, then the control voltage is applied to an input of a voltage follower circuit (step 512). Otherwise, the control voltage is applied to an input node of an output transistor in step 510.

Figure 6:
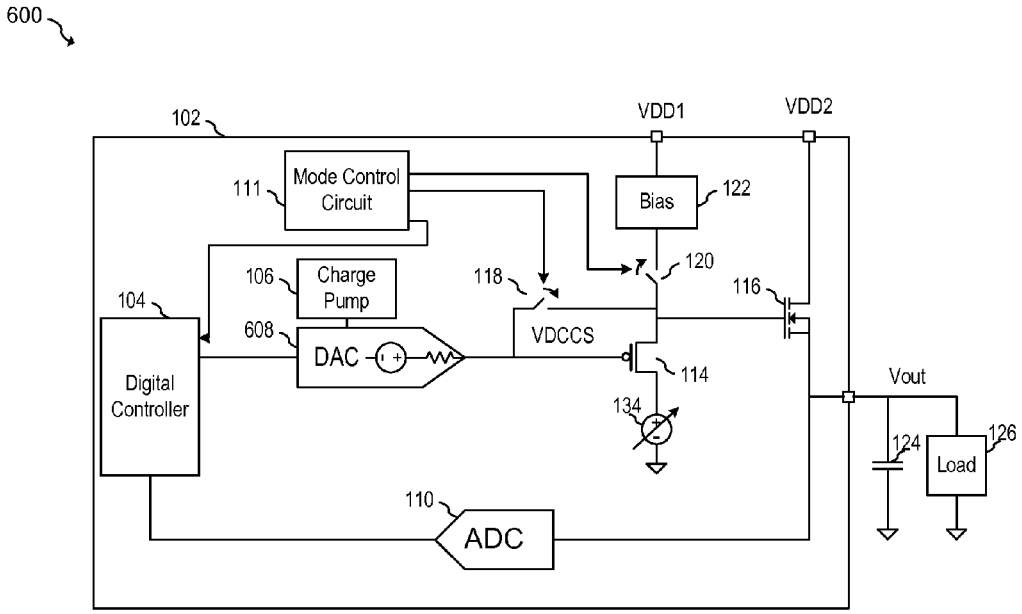
FIG. 6 illustrates a further embodiment linear voltage regulator.

FIG. 6 illustrates an embodiment linear regulator 600 in accordance with a further embodiment of the present invention. The structure and operation of linear regulator 600 is similar to linear regulator 100 illustrated in FIG. 1 with the exception that the IDAC and resistor have been replaced with voltage DAC 608. In such an embodiment, the first pole $\omega_P$, and the gate capacitance of the PMOS source follower transistors 114 is a function of the internal resistance of DAC 608, and may be expressed as follows:

$$\omega_{P1} = \frac{1}{2\pi R_{DAC} C_{G-PMOS}},$$

where $\omega_{P1}$, is the first pole angular frequency, $R_{DAC}$ is the resistance of resistor 112 and $C_{G-PMOS}$ is the gate capacitance of PMOS source follower transistor 114. It should be appreciated that a similar modification may be made to other embodiment linear voltage regulators. For example, in some embodiments, IDAC 108 shown in FIGS. 3 and 4*a-b* may be replaced by a voltage DAC.

Advantages of embodiments of the present invention include good power supply rejection. Since the gate of the pass transistor is driven by a source follower, the low driving impedance is able to "absorb" high frequency disturbances injected into the gate though the drain-gate capacitance. As such, some embodiment circuits may achieve better EMC immunity. A further advantage includes good stability vs. dynamic performance. In embodiments where at least one of the poles associated with the voltage follower transistor and the gate of the pass transistors are selected to be, for example, ten times higher than the open loop frequency of the linear voltage regulator, more loop gain may be applied by the controller to speed up the response time of the regulator while maintaining a stable loop.

Another advantage of embodiments includes the ability to characterize the control loop as a simple, small signal AC model. For example, the programmable DC current of the IDACs may be modeled as a continuous current. A further advantage of some embodiments include low output voltage ripple. For example, in embodiments where the product of the IDAC and the load resistance has a smaller LSB than that of the ADC, ripple may be significantly attenuated and/or eliminated. A further advantage also includes good low voltage performance. In embodiments, that bypass the voltage follower transistor in low voltage conditions, control of the voltage regulator loop can be maintained.

In accordance with an embodiment, a method of operating a power supply includes measuring an output signal of the power supply, determining a control voltage based on the measured output signal, and determining whether a supply voltage of a voltage follower circuit is greater than a first threshold. When the supply voltage of the voltage follower circuit is greater than the first threshold, the control voltage is applied to an input of the voltage follower circuit and an output of the voltage follower circuit is applied to a control node of an output transistor in a first mode. When the supply voltage of the voltage follower circuit is not greater than the first threshold, the voltage follower circuit is shut down and the control voltage is applied to the control node of the output transistor in a second mode. Determining the control voltage may include using a digital-to-analog converter having a voltage output or a current output.

Determining the control voltage may include determining a continuous control current based on the measured output signal, and applying the continuous control current to a resistor to determine the control voltage. In some embodiments, the resistor has a first value during the first mode and a second value during the second mode, the first value less than the second value.

In an embodiment, determining the continuous control current includes applying a first control algorithm to the measured output signal in the first mode and applying a second control algorithm to the measured output signal in the second mode. In an some embodiments, the method further includes converting the measured output signal to the digital domain at a first resolution, performing a digital control algorithm on the converted measured output signal to determine a digital current value, and converting the digital current value into the continuous control current by performing a digital-to-analog conversion. A product of a current of a least significant bit of the continuous control current multiplied by a resistance of the resistor is less than the first resolution in some embodiments.

In accordance with an embodiment, an integrated circuit includes a power supply controller having an input coupled to a power supply output terminal of the integrated circuit, an output stage coupled to an output of the power supply controller, a follower circuit having an input coupled an output of the output stage, an output transistor having an input coupled to an output of the follower circuit and an output coupled to the power supply output terminal, and a supply selection circuit configured to provide supply current to the follower circuit from an external power supply terminal in a first mode when a voltage of the external power supply terminal is above a first threshold, and to shut off the follower circuit and provide a voltage to the input of the output transistor in a second mode when the voltage of the external power supply terminal is below the first threshold.

In accordance with a further embodiment, an integrated circuit includes a power supply controller having an input coupled to a power supply output terminal of the integrated circuit, and a boosted current output stage coupled to an output of the power supply controller, such that the boosted current output stage is configured to provide a continuous current. The integrated circuit further includes a follower circuit having an input coupled an output of the current output stage, a first shunt resistor coupled to the output of the current output stage, an output transistor having an input coupled to an output of the follower circuit and an output coupled to the power supply output terminal, and a supply selection circuit configured to provide supply current to the follower circuit from an external power supply terminal in a first mode when a voltage of the external power supply terminal is above a first threshold, and to shut off the follower circuit and provide a voltage to the input of the output transistor in a second mode when the voltage of the external power supply terminal is below the first threshold. The integrated circuit may further include a charge pump coupled to a supply input of the current output stage.

In an embodiment, the supply selection circuit includes a first diode coupled between the external power supply terminal and the output of the follower circuit, and a second diode coupled between the output of the current output stage. The integrated circuit may further include a second shunt resistor coupled to an output of the current output stage, and a resistor selection circuit configured to activate the first shunt resistor in the first mode and activate the second resistor in the second mode. The resistor selection circuit may further include a comparator having a first input coupled to the output of the current stage and the output of the follower circuit.

In an embodiment, the power supply controller includes an analog-to-digital converter (ADC) coupled to the power supply output terminal of the integrated circuit and a digital controller coupled to the output of the ADC, and the current output stage comprises a first current digital-to-analog converter (IDAC). The current output stage may further include a second IDAC configured to be active during the first mode and not during the second mode. An output range of the second IDAC is larger than an output range of the first IDAC in some embodiments. In one embodiment, the output range of the first IDAC is less 2 LSBs of the output range of the second IDAC.

In an embodiment, the digital controller may be configured to perform a first control algorithm in the first mode and a second control algorithm in the second mode. In some embodiments, the follower circuit includes a PMOS device and the output transistor includes a DMOS device.

In accordance with a further embodiment, a linear voltage regulator includes an analog-to-digital controller (ADC) having an input coupled to an output terminal of the linear voltage regulator, a digital controller coupled to an output of the analog-to-digital controller, a first current digital-to-analog converter (IDAC) having an input coupled to an output of the digital controller, and a first resistor coupled to an output of the first IDAC, such that a product of a current of a least significant bit of the IDAC multiplied by a resistance of the first resistor is less than a voltage of a least significant but of the ADC. The linear voltage regulator also includes a voltage follower circuit having a control node coupled to an output of the first IDAC; and an output transistor having a control node coupled to an output of the voltage follower circuit and an output node coupled to terminal output terminal of the linear voltage regulator. In some embodiments, the digital controller is configured to implement a digital proportional-integral-differential (PID) controller.

In an embodiment, at least one of a first open loop pole due to a resistance of the first resistor and an input impedance of the voltage circuit and a second open loop pole due to an output impedance of the voltage follower circuit and an input impedance of the output transistor is at least ten times an open loop bandwidth of the linear voltage regulator. An open loop response of the linear voltage regulator may include a first open loop pole due to a resistance of the first resistor and an input impedance of the voltage circuit, and a second open loop pole due to an output impedance. Moreover, a frequency of one of the first open loop pole and the second open loop is at least ten times an open loop bandwidth of the linear voltage regulator, and a frequency of the other one of the first open loop pole is substantially coincident with a zero implemented by the digital controller.

In an embodiment, the voltage follower circuit comprises a transistor of a first type, the output transistor includes a transistor of a second type, and the linear voltage regulator further includes a first series transistor of the first type coupled in series with the first resistor, and a second transistor of the second type coupled in series with the first resistor. In some embodiments, the first type is PMOS, and the second type is DMOS. Moreover, the output transistor and the second transistor of the second type may be thermally coupled.

In an embodiment, the linear voltage regulator further includes a first diode coupled between the output of the first IDAC and the output of the voltage follower; and a second diode coupled between a first power supply terminal and the output of the voltage follower. The linear voltage regulator may also include a comparator having a first input coupled to an input of the voltage follower circuit and a second input coupled to the output of the voltage follower circuit, and a second resistor coupled to the output of the first IDAC, such that the first resistor and the second resistor are selected according to an output state of the comparator.

In an embodiment, the digital controller includes an input node coupled to an output of the comparator, and the digital controller is configured to implement a first control algorithm when the output of the comparator is in a first state and to implement a second control algorithm when the output of the comparator is in a second state. In some embodiments, the linear voltage regulator further includes a second IDAC coupled between the digital controller and an input of the voltage follower circuit, such that the first IDAC includes an smaller output range than the second IDAC, and the second IDAC is configured to be active when the output of the comparator is in a first state and is configured to be inactive when the output of the comparator is in a second state. In some embodiments, an input of the first IDAC is coupled to a first n least significant bits of an output of the digital controller, and an input of the second IDAC is coupled to a first m most significant bits of the output of the digital controller.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, embodiment switch drivers could be used to tune oscillators by switching in and out capacitors and other tuning components. Embodiment switch driver circuits may also be applied to receive/transmit switches, attenuators, power amplifier bypass circuits, RF matching, RF filter switching in general, as well as other types of circuits and systems.

What is claimed is:

1. A method of operating a power supply, the method comprising:

measuring an output signal of the power supply;

determining a control voltage based on the measured output signal;

determining whether a supply voltage of a voltage follower circuit is greater than a first threshold;

when the supply voltage of the voltage follower circuit is greater than the first threshold, applying the control voltage to an input of the voltage follower circuit and applying an output of the voltage follower circuit to a control node of an output transistor in a first mode; and when the supply voltage of the voltage follower circuit is not greater than the first threshold, shutting down the voltage follower circuit and applying the control voltage to the control node of the output transistor in a second mode.

2. The method of claim 1, wherein determining the control voltage comprises:

determining a continuous control current based on the measured output signal; and applying the continuous control current to a resistor to determine the control voltage.

3. The method of claim 2, wherein the resistor comprises a first value during the first mode and a second value during the second mode, the first value less than the second value.

4. The method of claim 2, wherein determining the continuous control current comprises applying a first control algorithm to the measured output signal in the first mode and applying a second control algorithm to the measured output signal in the second mode.

5. The method of claim 2, further comprising:

converting the measured output signal to the digital domain at a first resolution;

performing a digital control algorithm on the converted measured output signal to determine a digital current value; and converting the digital current value into the continuous control current by performing a digital-to-analog conversion.

6. The method of claim 5, wherein a product of a current of a least significant bit of the continuous control current multiplied by a resistance of the resistor is less than the first resolution.

7. The method of claim 1, wherein determining the control voltage comprises using a digital-to-analog converter.

8. An integrated circuit comprising:

a power supply controller having an input coupled to a power supply output terminal of the integrated circuit;

an output stage coupled to an output of the power supply controller;

a follower circuit having an input coupled an output of the output stage;

an output transistor having an input coupled to an output of the follower circuit and an output coupled to the power supply output terminal; and a supply selection circuit configured to provide supply current to the follower circuit from an external power supply terminal in a first mode when a voltage of the external power supply terminal is above a first threshold, and to shut off the follower circuit and provide a voltage to the input of the output transistor in a second mode when the voltage of the external power supply terminal is below the first threshold.

9. The integrated circuit of claim 8, wherein the output stage comprises a boosted current output stage coupled to an output of the power supply controller, wherein the boosted current output stage is configured to provide a continuous current; and the integrated circuit further comprises a first shunt resistor coupled to the output of the current output stage.

10. The integrated circuit of claim 9, further comprising a charge pump coupled to a supply input of the current output stage.

11. The integrated circuit of claim 9, wherein the supply selection circuit comprises:

a first diode coupled between the external power supply terminal and the output of the follower circuit; and a second diode coupled between the output of the current output stage.

12. The integrated circuit of claim 9, further comprising:

a second shunt resistor coupled to an output of the current output stage; and a resistor selection circuit configured to activate the first shunt resistor in the first mode and activate the second resistor in the second mode.

13. The integrated circuit of claim 12, wherein the resistor selection circuit comprises a comparator having a first input coupled to the output of the current stage and the output of the follower circuit.

14. The integrated circuit of claim 9, wherein:

the power supply controller comprises an analog-to-digital converter (ADC) coupled to the power supply output terminal of the integrated circuit and a digital controller coupled to the output of the ADC; and the current output stage comprises a first current digital-to-analog converter (IDAC).

15. The integrated circuit of claim 14, wherein:

the current output stage further comprises a second IDAC configured to be active during the first mode and not during the second mode; and wherein an output range of the second IDAC is larger than an output range of the first IDAC.

16. The integrated circuit of claim 14, wherein the digital controller is configured to perform a first control algorithm in the first mode and a second control algorithm in the second mode.

17. The integrated circuit of claim 8, wherein:

the follower circuit comprises a PMOS device; and the output transistor comprises a DMOS device.

* * * * *